US005149201A

United States Patent [19]

Benoit

[11] Patent Number: 5,149,201

[45] Date of Patent: Sep. 22, 1992

[54] ANGLE SEALED BOTTOM GROCERY SACK

[76] Inventor: Gordon L. Benoit, 952 Oakridge Rd., Victor, N.Y. 14564

[21] Appl. No.: 434,597

[22] Filed: Nov. 13, 1989

Related U.S. Application Data

[63] Continuation of Ser. No. 264,662, Oct. 31, 1988, abandoned, which is a continuation of Ser. No. 53,442, May 22, 1987, abandoned, which is a continuation of Ser. No. 815,978, Jun. 3, 1986, abandoned, which is a continuation-in-part of Ser. No. 606,320, May 2, 1984, abandoned.

[51] Int. Cl.[5] ..... B65D 30/10; B65D 33/10

[52] U.S. Cl. ..... 383/8; 383/120; 383/121; 383/903

[58] Field of Search ..... 383/8, 121, 107, 108, 383/104, 120, 121, 903

[56] References Cited

U.S. PATENT DOCUMENTS

| | | | |
|---|---|---|---|
| 2,294,220 | 8/1942 | Albertson | 383/108 X |
| 3,119,548 | 1/1964 | Cook et al. | 383/121 |
| 3,204,760 | 9/1965 | Whiteford | 383/107 X |
| 3,580,486 | 5/1971 | Kugler | 31/8 |
| 3,660,959 | 5/1972 | La Fleur | 61/17 |
| 3,669,347 | 6/1972 | Platz et al. | 383/104 |
| 3,739,977 | 6/1973 | Shapiro et al. | 383/104 |
| 3,857,329 | 12/1974 | Lehmacher et al. | 1/86 |
| 4,165,832 | 8/1979 | Kuklies et al. | 33/6 |
| 4,529,090 | 7/1985 | Pilon | 383/8 X |
| 4,554,192 | 11/1985 | Benoit | 383/8 X |
| 4,812,055 | 3/1989 | Prader et al. | 383/903 X |

FOREIGN PATENT DOCUMENTS

| | | | |
|---|---|---|---|
| 1923551 | 11/1970 | Fed. Rep. of Germany | 383/107 |
| 1342346 | 9/1963 | France | 383/121 |
| 1409321 | 7/1965 | France | 383/121 |
| 61848 | 5/1968 | German Democratic Rep. | 383/8 |
| 997615 | 9/1972 | Japan | 383/8 |
| 100504 | 12/1940 | Sweden | 383/121 |
| 694695 | 7/1953 | United Kingdom | 383/107 |
| 1010094 | 11/1965 | United Kingdom . | |
| 1275399 | 5/1972 | United Kingdom | 383/120 |

*Primary Examiner*—Stephen Marcus
*Assistant Examiner*—Jes F. Pascua

[57] ABSTRACT

A bag structure of a thermoplastic film material comprising front and rear bag walls connected by side walls and having an open mouth top portion, said open mouth portion being characterized by having handles located at opposite end regions thereof, said handles being of two films as a result of being integral extensions of said front rear and gusseted side walls, said bag having a bottom wall planarly extensible so as to form a rectangle with at least no substantial excess film outside of the bulk volumetric capacity of said bottom region of said bag. This invention also provides a method and system for preparing flat bottom thermoplastic sacks comprising process steps and means for forming a tube of thermoplastic film, collapsing said tube while forming two oppositely disposed gussets therein, forming two pairs of diagonal sealed seams in the gussets, forming a transverse sealed seam across the tube along a line which includes the inboard ends of the diagonal seams and forming pre-weakened transverse lines closely adjacent to said transverse sealed seam or forming a severing line along this line, removing the four double triangular regions bounded by the diagonal seams, the transverse seams and the side edges of the tube and collecting the resulting structures either while still interconnected or by stacking the severed sacks. The final structure can have handles or it can be handleless.

19 Claims, 3 Drawing Sheets

PRIOR ART

ANGLE SEALED BOTTOM GROCERY SACK

CROSS-REFERENCE AND RELATED APPLICATION DATA

This is a continuation of application Ser. No. 264,662, filed Oct. 31, 1988, now abandoned.

This application is a continuation of application Ser. No. 053,442, filed May 22, 1987, which was a continuation of application Ser. No. 815,978, filed June 3, 1986 which in turn is a continuation-in-part of application Ser. No. 606,320, filed May 2, 1984. Application Ser. No. 606,320 specifically incorporates by reference all of the disclosure of application Ser. No. 606,120, filed May 2, 1984, now Benoit U.S. Pat. No. 4,554,192. Each of these applications is hereby incorporated by reference herein.

BACKGROUND OF THE INVENTION

The present invention relates to a thermoplastic bag having integral handles and also to individual bag packs of such bag structures. The type of bag contemplated herein is particularly adapted for use as a grocery sack capable of carrying loads up to about 30–35 pounds.

The present invention also relates to methods and systems for preparing a thermoplastic sack, and, more particularly, to methods and systems for preparing such a sack having at least a substantially flat rectangular bottom. One type of bag contemplated for preparation by a system and process of the present invention is more particularly defined in U.S. Pat. No. 4,554,192, issued Nov. 19, 1985.

For years in the United States the means for carrying items purchased in a grocery store or supermarket has been the paper sack. This sack, as is well known, is made of kraft paper, which has a high beam strength as compared, for example, with thermoplastic film. Thus, bags made of this material, when fully extended, are capable of supporting themselves. When such bags are filled with grocery items, they have the desirable attribute of being able to stand upright. In addition, kraft paper bags are made so as to have opposing gusseted sides and a foldable-extensible rectangular bottom. This type of structure, when fully extended, provides the maximum volumetric efficiency for a container of this type. The volume of such a sack is represented by a rectangular bottom projected to the height of the bag.

These two attributes are about the only positive aspects of kraft paper grocery sacks. When folded and collapsed they are bulky and occupy considerably more space than thin film thermoplastic grocery sacks. Whatever cost advantage paper grocery sacks enjoyed in the past appears to be disappearing. Paper grocery bags are notorious for their lack of wet strength in an environment which constantly exposes them to the deleterious effects of aqueous liquids. This causes the bags to fail and spill their contents on the supermarket floor, the parking lot blacktop, the purchaser's automobile, or during transfer from the automobile to the purchaser's home. The time needed for supermarket employees to fill kraft paper sacks as opposed to thermoplastic film grocery sacks, is on average, longer. Such bags produce paper cuts, which have become an occupational hazard with kraft paper bags. Kraft paper bags have limited re-use possibilities and they are not a stable land fill material.

In the late 1970's and early 1980's, thin film thermoplastic handled grocery sacks began to make significant inroads into an area totally dominated by the kraft paper grocery sack.

U.S. Pat. No. 4,165,832, the disclosure of which is incorporated by reference herein in its entirety, describes to some degree, the evolution of handled bags from the time when handle elements were separately attached to the open mouth portion of the bag. This patent also discusses the improvement of forming an ungusseted bag having integral thermoplastic handles as a part thereof. This ungusseted type of bag is constructed from a pillowcase type blank consisting of two sheets of plastic, e.g., from a collapsed tube, sealed at opposite ends. A U-shaped cutout at one end fashions an opening for the bag and a separate cut or slit opens two loops which constitute the handles of the bag. A further evolution in this bag structure came about when the bag was made to have gusseted sides. This permitted the handles to be fashioned of two layers of film which gave the handles additional strength. In all cases, the bottom of the bag constituted either a heat sealed double layer of film, or in the case of a gusseted structure, the molds of the gusset were sealed at the bottom between the front and back sides of the bag. This latter seal can be considered the "trapped gusset" seal.

Since the late 1970's to the present time, the commercial plastic grocery sack has had a bottom region which has not changed. FIGS. 1–4 of the present application illustrate a thermoplastic film grocery sack of the general type manufactured by almost every thermoplastic grocery sack manufacturer in the United States. This grocery sack is made by collapsing a thermoplastic tube, and while in the process of collapsing, forming therein two side gussets. The gussets are represented in FIG. 2 by in-folded regions 16 and 18 on one side and 20 and 22 on the opposite side. After the gusseted tube has been fully collapsed, it is sealed and severed along lines 26 and 28. Seal line 28 is the handled and open mouth end portion of the bag after plastic film is removed, forming both the bag mouth opening and handles of the bag. Seal line 26 constitutes the closed end of the bag. As will be appreciated, during the sealing of the bottom region of the bag, four films are heat sealed together at the outboard region of the bag, i.e., 12, 16, 18 and 14 on the one side and 12, 20, 22 and 14 on the other side, and in the center region only two films, 12 and 14, are heat sealed together.

This bag bottom structure, adopted almost exclusively by the plastic grocery sack manufacturers, has at least two shortcomings. The first is that whenever there is a thickness transition involving a heat seal, where a thicker region transitions down to a thinner region, as in the gusset region of four layers transitioning at a fold point down to the two layers of the front and rear panels of the sack, a weak spot is created at the fold point. This becomes a tear initiation point as the bag is loaded with goods and the bag tries to expand to accommodate the goods. The bottom of the gusset being trapped and sealed within the front and rear panels of the bag in the regions 32 of FIG. 1 at both bottom outboard regions of the bag cannot expand to accommodate goods in the bottom of the bag as well as it can in the upper midway region of the bag where the side gussets expand to the minimum. FIG. 3 shows a side view of the bag of FIG. 1 in an expanded condition. It will be noted that the lower region 30 of the bag has less effective volume than the central region 34 of the bag. As indicated, because the bottom of the gusset on both sides of the bag is trapped and sealed between the front and rear layers of the bag walls, they cannot expand to accommodate increasing bag expansion caused by goods being loaded therein Weight and hoop stress forces are brought to bear at points 36 on both sides of the bag, with the result that tears in the bottom seal are initiated at these points. This asymmetrical load distribution places no load on the bottom seal between 36 and the bag corner. As the hoop and load forces increase, the tears can progress to permit the product to fall from the bag. Since this type of grocery sack is suspended from its integral handles, there is no bottom support safeguard to protect items from falling through the bottom of such a bag.

The second disadvantageous aspect of such a seal-trapped gusset arrangement, is the fact that the sides of the bag cannot expand to their full width and, thus, full volumetric efficiency is sacrificed. When examined carefully, for example, in a bag as described, measuring 12 inches by 8 inches (4 inch gussets) by 24 inches, including handle length, a significant percentage of the bag film (excluding the handles) does not contribute to bag volume. Over 8% of the bag film is wasted in the bottom of the bag because of the trapped gussets.

U.S. Pat. No. 3,119,548, issued Jan. 28, 1964, describes a thermoplastic bag having a square or rectangular bottom which avoids the trapped gusset structure. This sack, however, is intended as a liner for a cardboard ice-cream container. Thus, this structure never was intended to support product load by means of its own integrity. An outer-container provided shape and support for the thermoplastic liner. This liner is not used with handles.

U.S. Pat. No. 3,580,486 describes a thermoplastic film bag which has a rectangular bottom without a seam or seal, and ungusseted sides which contain three seals when the bag is expanded. This bag contains a center handle which is only one film layer thick because of the ungusseted side structure.

It is an object of the present invention to present a novel thermoplastic film bag and bag pack.

Yet another object of the invention is to present a thermoplastic film handled grocery sack which has maximum volumetric efficiency.

Still another object of the present invention is to present a thermoplastic film grocery sack having seam seals of exceptional integrity.

A further object of the present invention is to present a thermoplastic film handled sack which has a minimum of film not contributing to either volumetric capacity or handle support.

A still further object of the present invention is to present a thermoplastic film grocery sack which contains considerably less raw material for essentially the same volumetric capacity as trapped-gusset bags.

It is an object of the invention to present a process for the preparation of flat bottom sacks.

It is yet another object of the invention to present a process for the preparation of interconnected severable flat-bottomed grocery sacks.

It is still another object of the present invention to present processes of forming flat-bottomed thermoplastic film sacks not having handles.

It is yet another object of the invention to present a process for preparing flat-bottomed handled sacks in bag pack form.

A further object of the present invention is to present novel systems for the preparation of such thermoplastic film flat bottom sacks.

SUMMARY OF THE INVENTION

The present invention is concerned with a bag structure of a thermoplastic film material comprising front and rear bag walls connected by gusseted side walls and having an open mouth top portion, said open mouth portion being characterized by having handles located at opposite end regions thereof, said handles each being of two films as a result of being integral extensions of said front, rear and gusseted side walls; said bag having a bottom wall planarly extensible so as to form a rectangle with at least no substantial excess film outside of the bulk volumetric capacity of the bottom region of said bag.

The present invention is also concerned with a bag structure of a thermoplastic film material comprising front and rear bag walls connected by gusseted side walls and having an open mouth top portion, said open mouth portion being characterized by having handles located at opposite end regions thereof, said handles each being of two films as a result of being integral extensions of said front, rear and gusseted side walls; said bag having a bottom wall which is planarly extensible so as to form a rectangle said bottom being of integral extensions of said front, rear and gusseted side walls and the closure thereof being 4 two-film, gusset-to-wall, heat seals when said bottom is a square and 4 two-film, gusset-to-wall heat seals and 1 two-film, front wall-to-back wall heat seals when said bottom is a rectangle.

The present invention is also concerned with a method for preparing a handled, at least substantially flat, rectangular bottom, thermoplastic film sack comprising:

(a) forming a tube of a thermoplastic film;

(b) collapsing said tube while simultaneously forming therein two, oppositely disposed, parallel gussets;

(c) forming two pairs of diagonal sealed seams over the portions of the tube width corresponding to the gussets along lines diagonal to the length of the tube, the seal pairs of opposite sides being at an angle to one another and the seams of each pair being in registration with one another;

(d) forming a transverse sealing and severing seam across and through said collapsed tube along a line which includes the inboard ends of said pairs of diagonal seams;

(e) collecting a plurality of the resulting structures in a stack;

(f) removing from each structure the four folded triangles of film located between the diagonal sealed seams and the transverse sealing and severing seam to complete the bottom of the sack; and (g) forming a pair of handles and sack mouth opening at the opposite end of said sack bottom.

For a pack of such bags a tab member is removably attached to each side of the bag mouth opening and the tab fastened together.

The present invention is also concerned with a method of preparing gusseted web stock suitable for the formation of double film handle, thermoplastic bags comprising:

(a) providing a gusseted tube of thermoplastic film; and (b) continuously forming two pairs of diagonal sealed seams over the portions of the tube width corresponding to at least a major portion of the gussets along lines diagonal to the length of the tube beginning at the outer folds thereof, the seal pairs of opposite sides being at an angle to one another and the seams of each pair being in registration with one another, successive sealed pairs being spaced a bag length distance apart. After the gusseted lay-flat tube is so-diagonally sealed, a following operation can continuously remove a portion of the tube corresponding to the upper region of an individual bag so as to form a bag mouth opening and double-film loop handles while simultaneously transversely sealing the bottom of the bag along a line which includes the ends of said diagonal seals. Thereafter, or simultaneously, the four triangular regions outside of the diagonal seals can be removed as unnecessary film.

The present invention is also concerned with a method for preparing a handleless, at least substantially flat, rectangular bottom, thermoplastic film sack comprising:

(a) forming a tube of thermoplastic film;

(b) collapsing said tube while simultaneously forming therein two oppositely disposed, parallel, gussets; (c) forming two pairs of diagonal sealed seams over the portions of the tube width corresponding to the gussets along lines diagonal to the length of the tube, the sealed pairs of opposite sides being at an angle to one another and the seams of each pair being in registration with one another;

(d) forming a transverse sealed seam across said tube along a line which includes the inboard ends of said pairs of diagonal seams and simultaneously forming a pre-weakened transverse line closely adjacent and parallel to said transverse sealed seam;

(e) removing the four double film triangular regions bounded by said diagonal seams, said transverse seams and the side edges of said tube; and (f) collecting the resulting structures while still interconnected at said pre-weakened transverse lines. Another method according to the present invention involves continuously preparing a handleless, at least substantially flat, rectangular bottom, thermoplastic film sack comprising:

(a) forming a tube of thermoplastic film;

(b) collapsing said tube while simultaneously forming therein two oppositely disposed, parallel, gussets;

(c) forming two pairs of diagonal sealed seams over the portions of the tube which correspond to the gussets along lines diagonal to the length of the tube, the seal pairs of opposite sides being at an angle to one another and the seams of each pair being in registration with one another;

(d) forming a transverse sealed seam across said tube along a line which includes the inboard ends of said pairs of diagonal seams and simultaneously severing said tube along a line parallel to said transverse seal seam;

(e) removing the four double film triangular regions bounded by said diagonal seams, said transverse sever line and the side edges of said tube.

DETAILED DESCRIPTION OF THE INVENTION

Figure 3:
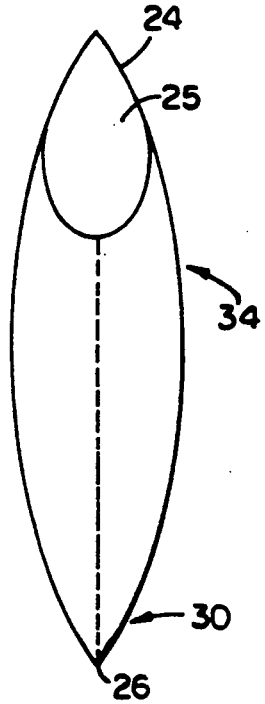
FIG. 3 is a side elevation view of the bag structure of FIG. 1 in volume expanded form.

As indicated above, FIGS. 1, 2, 3 and 4 represent different views of a bag structure 10 of the prior art. This bag has a front panel 12, a back panel 14 and gusseted sides represented by infolded members 16, !8, 20 and 22. The gusseted members are actually single side members creased at their longitudinal midpoint. Double film handles 24 are at the bag mouth end of the bag and these handles are sealed at line 28. Handle loop opening 25 is shown in FIG. 3. The bottom of bag 10 is sealed along line 26. As indicated above, this seal line 26 traps the side gussets at the bottom of the bag and prevents the bag from expanding fully, as more clearly shown in the region 30 of FIG. 3. This manner of sealing the bottom of the bag inadvertently produces tear initiation points 36 when bag filling forces attempt to expand the side gussets in the bottom region of the bag.

Figure 1:
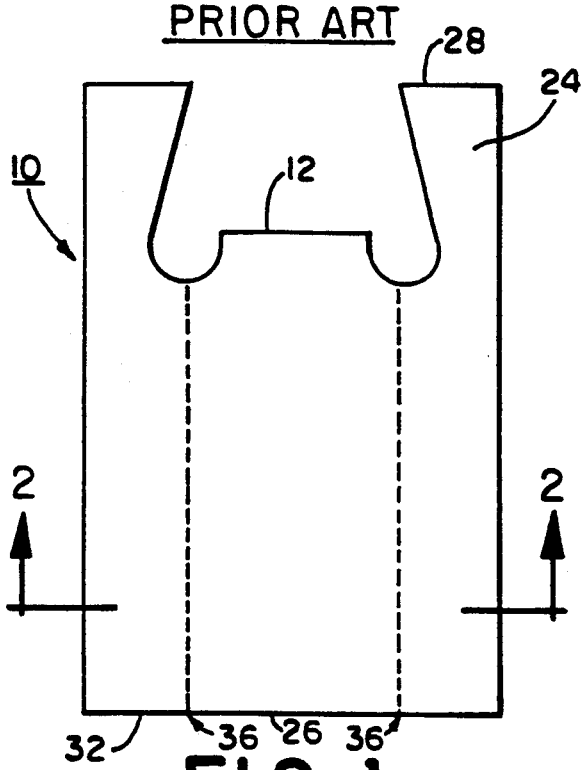
FIG. 1 is a front elevation view representing a thermoplastic sack of the prior art.
Figure 2:
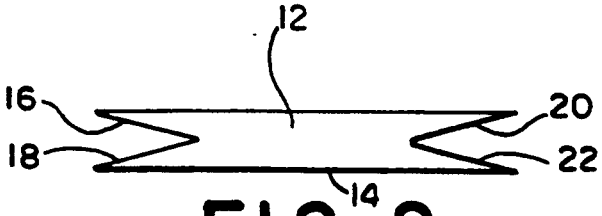
FIG. 2 is an end view taken along the lines 2—2 of FIG. 1.
Figure 4:
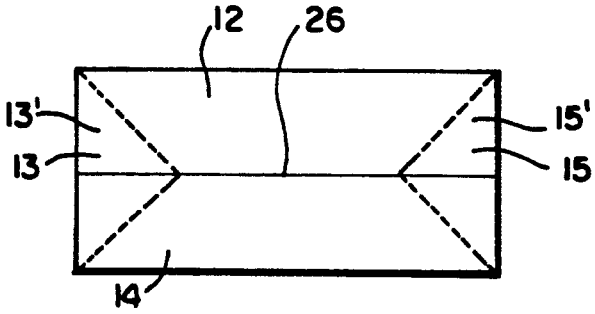
FIG. 4 is a bottom view of the bag of FIG. 1 with the bottom of the bag planarly extended to the exact dimensions of the four sides of the bag.
Figure 5:
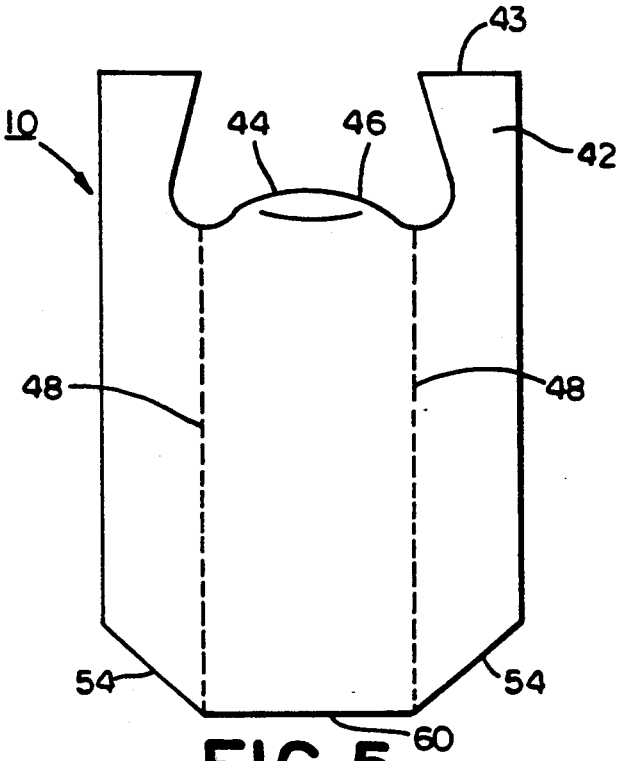
FIG. 5 is a front elevation view of one form of the thermoplastic bag structure of the present invention.

FIG. 4 is illustrated herein in order to show that when a bag of the prior art, such as that illustrated in FIGS. 1, 2 and 3 has the bottom thereof planarly extended to the full dimensions of its sides and walls there will seem to be two perfectly square segments of thermoplastic film externally of the inside of the bag which contributes nothing to the volumetric capacity of the bag. Moreover, this excess apparently does not contribute to the strength of the bag. This figure is best appreciated by envisioning a cardboard box having the exact front width, gusset-side and rear width dimensions of the prior art bag illustrated in FIG. 1. When such a box is placed into the bag, so that like sides of the bag and the box correspond, and the box is pushed snugly to the bottom of the bag then the bottom of the bag will assume the configuration shown in FIG. 4. Part of front panel 12 of the bag will actually become part of the bottom of the bag, as will back panel !4. Bottom heat seal seam 26 will extend all the way across the mid-point region of the bottom of the bag. By placing such a box within the bag, there will be formed in the exterior of the bottom of the bag two triangular shaped pockets, made up of identical right-angle triangular film members, 13 and 13' on one side and 15 and 15' on the other side. The present invention has discovered that the two triangular pockets can be removed by the elimination of triangles 13 and 13' and 15 and 15' which together constitute two perfectly square segments of film which do not materially contribute to the structural integrity or the volumetric efficiency of the bag. After removal of these segments and forming the appropriate bottom seals from adjacent film edge regions, the bag then has the bottom configuration shown in FIG. 7. The result is a savings of a considerable percentage of the raw material employed in the bag and the creation of the first practical flat-bottomed thermoplastic sack having double film handles as more fully described with reference to the remaining Figures.

Figure 8:
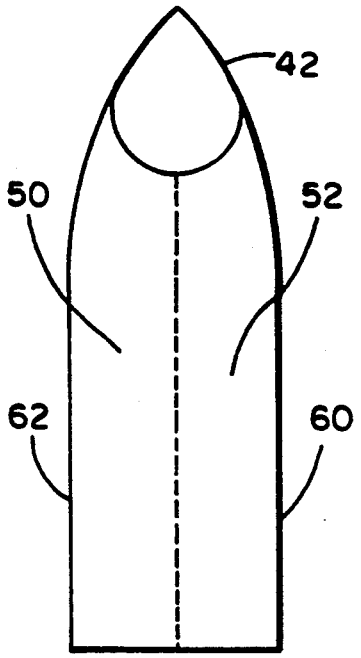
FIG. 8 is a side elevation view of the bag structure of FIG. 5 in volume expanded form.
Figure 6:
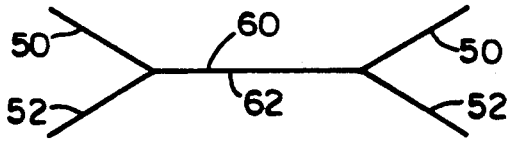
FIG. 6 is a bottom end view of the bag structure of FIG. 5.

FIGS. 5, 6, 7 and 8 illustrate a rectangular bottom bag 40 having double film thickness handles 42 at the bag mouth end of the bag. These handles are sealed along lines 43. Each bag has two tabs 44 in registration each has a pre-weakened tear-off region 46 for removal of each bag 40 from a plurality of superimposed bags connected together by way of tabs 44 in some suitable fashion. They may be heat-bonded, stapled, clipped or held together by any means. Pre-weakened region 46 can be a line perforations for bag tear-off or a continuous, somewhat arcuate slit terminating just short of the mouth of the bag, leaving two small web regions which can be snap-severed to free a bag from a bag pack. Dotted lines 48 illustrate the extent of infolding of gusset members 50 and 52, as more clearly shown in FIG. 6. When fully extended, these gusset members become bag sides 50–52, as shown in FIG. 8.

Figure 7:
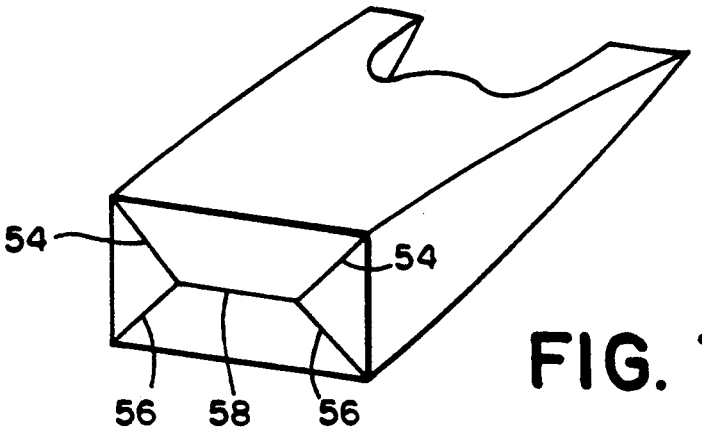
FIG. 7 is a bottom perspective view of the bag structure of FIG. 5 in volume expanded form.

The bottom of bag 40 is preferably constructed of 5 two-film heat seals, two heat seals 54, two heat seals 56 and a central heat seal 58. Heat seal 58 is the result of heat sealing front bag panel 60 to rear bag panel 62. Heat seal 54 is formed by heat sealing front bag panel 60 to gusset panel 50 and heat seal 56 is formed by heat sealing rear bag panel 62 to gusset panel member 52. As will be appreciated, the bottom is formed by heat sealing no more than two films at any one point. This avoids any tear initiation point resulting from sealing a thick region to a thin region. The unnumbered outer peripheral lines of the bottom of FIG. 7 are shown as if a perfect rectangular object were giving it this form. This would be the ideal utilization of such a bag and is so shown to illustrate the greater available volume of the subject bag.

A double film handle rectangular bottom bag is a novel structure particularly for supporting loads up to and greater than about 35 pounds. The above-described structure results in a thermoplastic bag which can be laid flat, as with the prior art structure, and occupy no more vertical space than the prior art bags. As indicated above, they can be fashioned into bag packs of any suitable number and hung from the region of tab 44 in some suitable manner for dispensing the bags one at a time. In use, product will be placed through the bag mouth opening and as more product is loaded into the bag, the bottom thereof will attempt to become planarly extended. In doing so, maximum volumetric efficiency can be utilized. By "planarly extended" or "planarly extensible" is meant that the bottom of the bag can unrestrictedly be extended to be perfectly flat and rectangular in shape. For having the capability of forming a perfectly flat bottom, seal line 54 and 56 should form at least approximately a 45° angle with gusset line 48 or an angle of at least approximately 135° with seal line 58 when the bag is in its lay flat condition. Obviously, these angles can deviate more or less from these limits, but the consequences will be a bag bottom which is correspondingly less planar. This is still within the spirit of the invention. Thus, it is the intention of the present invention to cover bag bottoms of the described type which are at least generally planar when the bag is extended.

In a modification of the bag structure illustrated in FIGS. 5, 6, 7 and 8, the gusset lines 48 can be in-folded to a maximum so that they meet at the midline of the bag. The consequence of this modification, after cutting the corners at an angle of at least approximately 45° to the midline and then forming the two-film seals, as indicated above, will be a square bottomed bag. In the instance of a square bottomed bag, the two-film heat seal, line 58 of FIG. 7, for example, is reduced to nonexistence. The two apexes of the heat seals 54 and 56 contact one another and the bottom of the bag then will have an X-shaped heat seal with the lines forming the X being at least approximately equal. In other words, the bottom closure of the bag is preferably formed from 4 two-film heat seals. A suitable bag mouth opening and double film handle are also fashioned into the bag.

Figure 9:
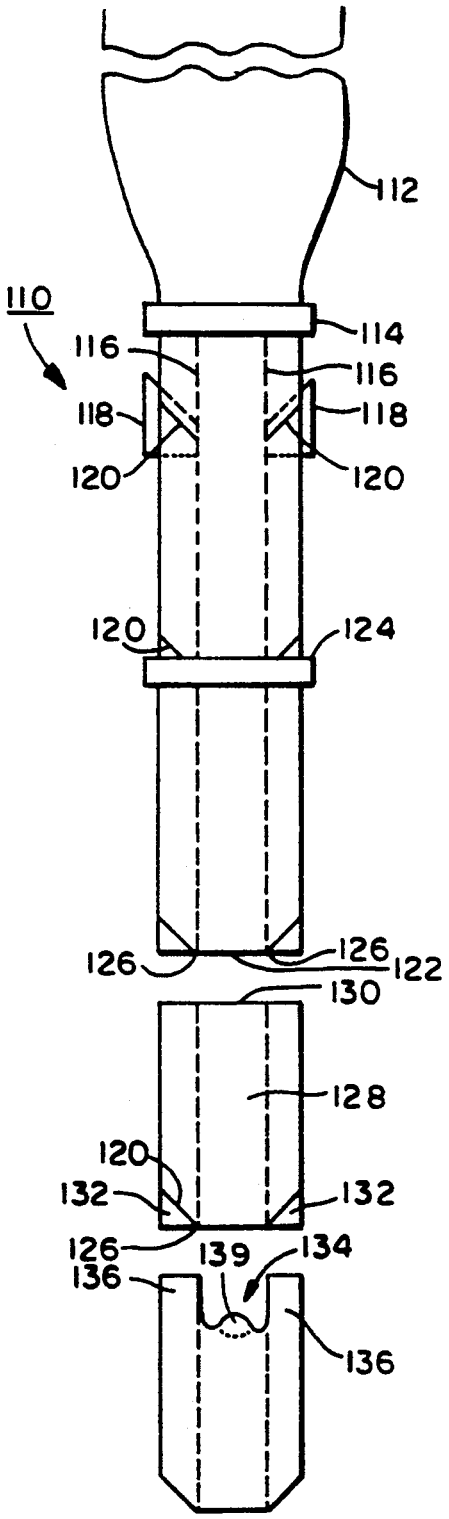
FIG. 9 is a plan view, in schematic form illustrating a system and process sequence of one form of the present invention.

As indicated in FIG. 9, 110 illustrates a system and process sequence for forming a handled, gusseted, flat bottomed thermoplastic sack. A tube of thermoplastic film 112 is in the process of being collapsed, by passed through a gusset forming means 114.

The tube collapsing and gusset-forming means 114 can be any device suitable for accomplishing these two steps substantially simultaneously. A typical gusset-forming device is an open-ended box shaped arrangement of, for example, sheet metal material, which has two inwardly extending members which are brought to bear on the collapsing thermoplastic tube so as to form two oppositely disposed inwardly extending folds o gussets. The device gradually tapers to cause the gusseted tube to collapse completely. These gussets are illustrated in the drawing by dotted lines 116. The gusset-forming means 114 can be prepared in a plurality of different size gusset-forming means so a to permit flexibility in the dimension of the resulting gusset in-fold. The gusset-forming means can be such as to impress a gusset in a tube of anywhere from a fraction of an inch up to that providing gussets which extend all the way to the midline of a fully collapsed tube. The gusseted portion of the tube thereafter transverses two Teflon coated plates 118, (or some other suitable non-stick separating surface) each of which extend into the full reach of the gusset 116. Thereafter, a sealed seam is impressed in each of the four gusset folds as shown at 120. The Teflon plate prevents one seam from fusing to the other on each side of the tube. These seams are best formed by heat-sealing members which are Teflon-coated resistance wires heated to a temperature which will permit the two layers of each of the four gusset folds to be heat-sealed together but not severed. These diagonal sealed seams extend over the portions of the tube width corresponding to the gussets along lines diagonal to the length of the tube and the seal pairs of opposite sites are at an angle to one another, preferably at an angle of at least approximately 90°. The seams of each pair of seams on each side of the gusseted tube are in registration with one another. In other words, beneath seam 120, and on the other side of Teflon separator plate 118, there is an identical seal 120. As the tube and seals 120 progress through the system there is subsequently formed a bottom seal 122 which simultaneously seals and severs the bottom of the gusseted structure. This is accomplished by means of bottom sealing and severing device 124. Seal line 122 is a transverse sealing and severing seam which extends across and through the collapsed tube along a line which includes the inboards ends 126 of each pair of diagonal seams. Transverse sealing and severing device 124 can be any suitable means which will bond and sever the collapsed tube along the defined line. This sealing and severing action will isolate sack blank 128 from the collapsed and gusseted tube. Sack blank 128 will have a seal 130 across the top thereof and 4 triangular regions 132 will be bounded by seal lines 120, 126 and the side edge of the gusseted structure. The sack blank structures 128 may be separately or collectively converted into bag structures by removal of the triangular regions 132 and by the formation of bag mouth opening 134 which simultaneously forms handle loops 136, each of which are formed of two layers of film by virtue of the gusseted structure. This will complete the formation of a handled sack, the bottom of which can be planarly extended so as to have a flat bottom.

In a preferred embodiment of the process and system illustrated in the drawing, a linear low density polyethylene tubular film 112, of about 1 mil in thickness, is collapsed and simultaneously gusseted by passing through gusset-forming means 114. This action infolds the collapsed tube to yield gussets 116. As the gusseted tube progresses through the system, seals 120 and 126 ar simultaneously formed. This action produces bottom seal 126 and top seal 130 at the same time. This also isolates sack blank 128. Sack blank 128 can then be removed to a station which can separately remove triangular sections 132 and bag mouth opening 134 and form handles 136 on individual blanks. Alternatively, the blanks 128 can be stacked in vertical registration and through the means of suitable cutting die mechanisms, the triangular regions removed and the handle and bag mouth opening can be formed. A typical bag can have a bag front and rear wall width of about 12 inches, 4-inch gusset folds, yielding 8 inched side walls and a bag length of about 20–25 inches with or without handles.

Figure 10:
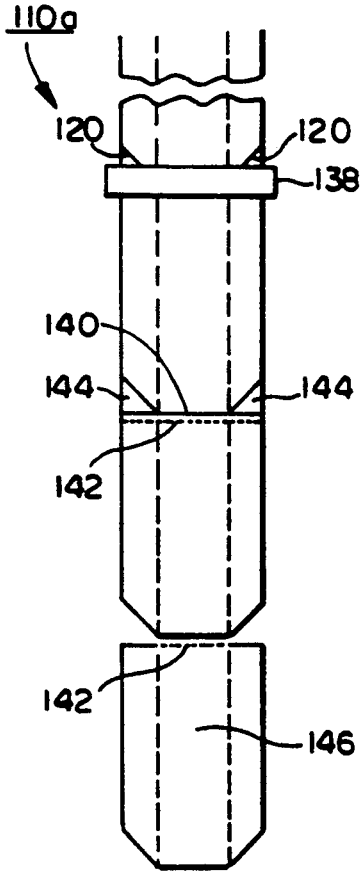
FIG. 10 is a plan view of another form of the process and system of the present invention.

For the formation of bags which do not contain a handle, the process and the system are as shown in FIG. 10. The process and system 110*a* is different from that of FIG. 9 beginning at the point where the bottom of the bag is sealed. Thus, a bottom seal and perforating mechanism 138 is shown impressing seal seam 140 in the flattened gusseted tube and, simultaneous therewith, perforation line 142 is formed closely adjacent and parallel to seal line 140. Seal line 140 and perforation line 142 are impressed in the gusseted tube at the same time diagonal seals 120 are impressed into the gussets. Thereafter, by any suitable die cutting mechanism, the four regions 144 are removed from the structure. This will yield sack 146 attached by perforation line 142 to a like structure. Thereafter, these sacks may be rolled upon themselves to form a cylindrical package, collected in a zig-zag folded stack arrangement or individually separated and folded or stacked. Either structure will permit a sack to be torn free along the perforation lines to yield an open mouth bag which when extended fully to the total width of the gusset, will yield a flat-bottomed sack. The sack resulting from the process and system of FIG. 10 will have a rectangular bottom with a length larger than its width.

In a modification of the process and system shown in FIG. 10, open mouth handleless structures can be formed by forming a severance transversely across the tube at the same time bottom seal 140 is formed. Thereafter, the corners of the sack blank corresponding to regions 144 can be severed to complete the bag structure.

Bags of the structures described can be formed with a pair of registered tabs as integral extensions of the bag mouth as shown at 39 in FIG. 9. The bags can be stacked in registration to contain 50, 100, 150, etc., bags and the tabs 39 fastened together in some suitable manner. For example, the tabs can be ultrasonically welded together. A perforation line across the tab will form a convenient tear-off site for individual bags to be removed from the bag pack.

Bags of the structures described can be formed by employing any suitable thermoplastic material, for example, polyolefins, and more particularly, polyethylene. In employing the term "polyolefins" it is employed generically to include all forms of the polymer species including, for example, low density polyethylene, linear low and/or high density polyethylene, mixtures and blends of the same, copolymers of ethylene, other alpha olefins, and other monomer counterparts, etc. Thermoplastic coated paper stock is also contemplated. The bag film can be of any gauge, for example, from about 0.25 to about 5 mils in thickness.

In forming the flat-bottomed bag, it is preferred that the open mouth portion of the handled sacks of the present invention have stress relief curves or arcs extending from the base of the handle to a raised portion of the bag mouth. This will militate against splitting o tears occurring in the bag mouth during handle extension or when the bag is being filled with bulky material. The handles and bag mouth opening can have any configuration.

In forming the bag structure, the pertinent angles need not be precise, e.g., exactly 90°, 45°, or 135°. Reasonable processing latitude should permit some deviation from these guidelines. Likewise, in forming seal seams, the ends thereof can be curved or angled in order to accommodate or insure good closure at all film interfaces and joints. Double or plural line seams and seals are also contemplated.

As disclosed, the bag structure formed by the system and process illustrated in FIGS. 9 and 10 will yield a sack having a rectangular bottom when planarly extended, which bottom will have a length longer than its width. In other words, the sack bottom will not be a square. In order to form a square bottom sack either with or without handles, the process and means merely need to be modified so that the gusset folds are both infolded to the maximum. That is, the collapsed tube will be gusseted to the longitudinal mid-line of the tube. In this case, the center-fold of each gusset will contact the other and the angle between the thereafter formed diagonal seams will be at least about 90°. The resulting sack will then have a substantially flat square bottom when planarly extended.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A grocery bag structure of a thermoplastic film material comprising front and rear bag walls connected by gusset panels and having an open mouth top portion, said open mouth portion being characterized by having handles located at opposite regions thereof, said handles being of double films as a result of being integral extensions of said front and rear walls and gusset panels, said bag having a bottom closure including a central two-film heat seal formed by sealing said front and rear bag walls and four diagonal heat seals outside of said central heat seal and formed by sealing said gusset panels to said front and rear bag walls with no substantial trapped gusset in said bag bottom closure.

2. The grocery bag structure of claim 1 wherein each of said four diagonal heat seals comprises an inboard end lying at the intersection of a gusset fold line and said central two-film heat seal.

3. The grocery bag structure of claim 1 wherein said bottom closure comprises a double seal.

4. The grocery bag structure of claim 1 wherein said central two-film heat seal is disposed along a line which includes an inboard end of each of said four diagonal heat seals.

5. A grocery bag structure of a thin thermoplastic film material comprising front and back walls connected by gusseted side walls, each gusseted side wall comprising a pair of gusset panels, there being an open mouth portion characterized by handles located at opposite regions thereof, said handles being of double films as a result of being integral extensions of said front, back and gusseted side walls, said bag having a bottom and a bottom closure, the bottom closure defining the weight-bearing portion of said bottom, the bottom closure comprising a two-film gusset to wall seal diagonally disposed on each gusset panel and a two-film front wall to back wall seal, each two-film gusset to wall seal extending at an angle from the outermost portion of each gusset panel to an outermost region of the two-film front wall to back wall seal.

6. A grocery bag according to claim 5 wherein each seal is a heat seal.

7. A grocery bag according to claim 5 wherein the two film gusset to wall seals define four triangular pockets.

8. A grocery bag according to claim 7 wherein the triangular pockets are comprised of excess film having no substantial volumetric capacity.

9. A grocery bag according to claim 7 wherein the triangular pockets are removed.

10. A grocery bag according to claim 5 wherein each pair of gusset panels combine to form a gusset fold line, each gusset fold line intersecting the two film front wall to back wall seal at an opposite end thereof to define two intersection points, each two-film gusset to wall seals having an end terminating substantially at one of said intersection points.

11. A grocery bag according to claim 5 wherein said bottom has no substantial excess film outside of the bulk volumetric capacity of the bag.

12. A grocery bag according to claim 5 wherein said bottom closure has no substantial trapped gusset therein.

13. A grocery bag according to claim 5 wherein each two-film gusset to wall seal extends at an angle of approximately 45°.

14. A grocery bag constructed of thermoplastic material comprising front and back walls connected by gusseted side walls, each gusseted side wall comprising a pair of gusset panels, there being an open mouth portion characterized by handles located at opposite regions thereof, said handles being double films as a results of being integral extensions of said front, back and gusseted side walls, said bag having a bottom portion and a bottom closure, the bottom closure defining the volumetric carrying portion of the bottom, the bottom closure comprising a two-film gusset to wall heat seal diagonally disposed on each gusset panel and a two-film front wall to back wall heat seal, there being a pair of gusset fold lines substantially intersecting opposing ends of the two-film front wall to back wall heat seal and defining intersection points, each two-film gusset to wall heat seal extending at an angle of approximately 45° from the outermost portion of each gusset panel to substantially the intersection points and defining a triangular region having no substantial useful volumetric capacity in said bag.

15. In a grocery bag structure of a thin gauge thermoplastic film material comprising front and rear bag walls connected by gusseted side walls comprising four gusset folds, said bag having an open mouth top portion which has handles located at opposite regions thereof, said handles being of double films as a result of being integral extensions of said front, rear and gusseted side walls; said bag having a bottom seal comprising a transverse seal including two spaced 4-film seals in a bottom gusset region of the bag and one 2-film seal therebetween, the improvement comprising 2-film sealing means located in each of the four gusset folds so as to relieve load stresses at a pair of thickness transition points between the four film seal points and 2-film seal points in said transverse seal.

16. The bag structure of claim 15 wherein said thin gauge thermoplastic film is from about 0.3 to about 1.5 mils.

17. The bag structure of claim 16 wherein said 2-film sealing means are diagonal seals extending within a line from the outer portion of each gusset fold to said transition points.

18. The bag structure of claim 17 having four triangular regions outside of the diagonal seals removed.

19. A grocery bag structure of a thin gauge thermoplastic film material comprising front and rear bag walls connected by gusseted side walls and having an open mouth top portion which has handles located at opposite regions thereof, said handles being of double films as a result of being integral extensions of said front, rear and gusseted side walls; said bag having a bottom seal comprising a transverse seal including two spaced 4-film seals in a bottom gusset region of the bag and one 2-film seal therebetween and in each of the four gusset folds a 2-film seal along a line extending at an angle from the outer portion of the gusset to the region where an innermost reach of the gusset is sealed at the bottom.

* * * * *